US007724119B2

(12) United States Patent
Krumme et al.

(10) Patent No.: US 7,724,119 B2
(45) Date of Patent: May 25, 2010

(54) INDUCTIVE ROTARY JOINT COMPRISING POLYMER MATERIAL

(75) Inventors: Nils Krumme, Feldafing (DE); Herbert Weithmann, Munich (DE); Harry Schilling, Eichstaett (DE); Georg Lohr, Eichenau (DE)

(73) Assignee: Schleifring und Apparatebau GmbH, Fuerstenfeldbruck (DE)

( * ) Notice: Subject to any disclaimer, the term of this patent is extended or adjusted under 35 U.S.C. 154(b) by 668 days.

(21) Appl. No.: 11/381,433

(22) Filed: May 3, 2006

(65) Prior Publication Data

US 2008/0088400 A1 Apr. 17, 2008

(30) Foreign Application Priority Data

May 3, 2005 (DE) ..... 10 2005 021 188

(51) Int. Cl.
*H01F 27/29* (2006.01)

(52) U.S. Cl. ..... 336/233

(58) Field of Classification Search ..... 336/65, 336/83, 200, 232–234, 196–199
See application file for complete search history.

(56) References Cited

U.S. PATENT DOCUMENTS 3,758,845 A * 9/1973 MacKelvie et al. .... 340/870.32
4,041,541 A 8/1977 Frossard et al.
4,320,080 A 3/1982 Esper et al.
4,429,314 A 1/1984 Albright
5,347,256 A * 9/1994 Yumiki et al. ..... 336/84 C
5,572,178 A * 11/1996 Becker et al. ..... 336/120
6,319,624 B1 * 11/2001 Watanabe et al. ..... 428/329
6,559,560 B1 * 5/2003 Jin et al. ..... 307/104
6,950,633 B2 * 9/2005 Kojima et al. ..... 455/73
2003/0020588 A1 1/2003 Jin et al.
2004/0066264 A1 * 4/2004 Matsuura et al. ..... 336/192
2005/0007232 A1 * 1/2005 Ono et al. ..... 336/213

FOREIGN PATENT DOCUMENTS

AT 354548 1/1979
EP 0587142 3/1994

* cited by examiner

*Primary Examiner*—Tuyen Nguyen
(74) *Attorney, Agent, or Firm*—Kevin L. Daffer; Daffer McDaniel, LLP

(57) ABSTRACT

The invention relates to an inductive rotary joint having at least two component parts which each comprise a coil for introducing power and/or taking-up power. In order that the rotary joint may be able to withstand even high mechanical load, at least one of the component parts is made of a synthetic resin containing soft magnetic particles, and the coil of the one part is at least partially located in the synthetic resin.

8 Claims, 3 Drawing Sheets

INDUCTIVE ROTARY JOINT COMPRISING POLYMER MATERIAL

Figure 1:
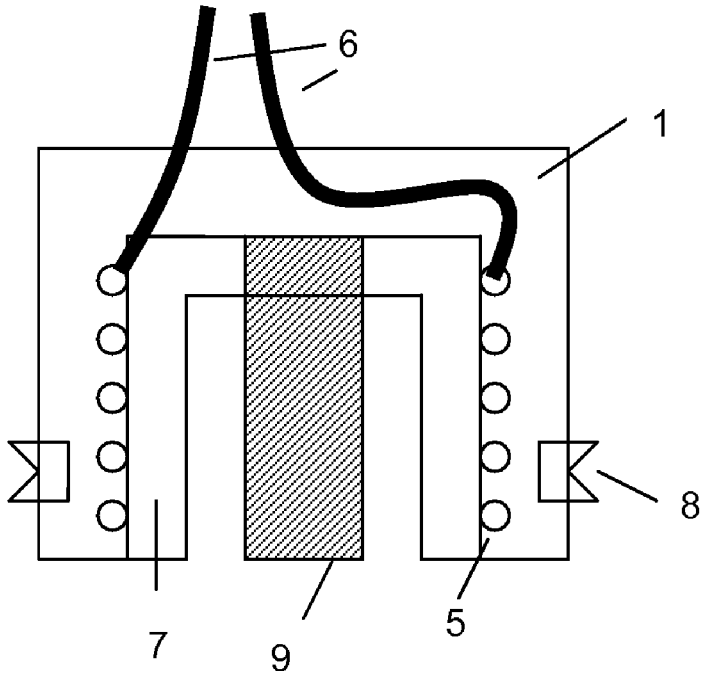

The invention relates to an inductive rotary joint having at least two component parts which are movable relative to each other and which each have at least one coil for introducing power and/or taking-up power.

A rotary joint of the initially-mentioned species is known from AT 354 548. For transmission of energy or signals by means of the rotary joint, this has two iron cores. Each iron core is provided with a winding. The windings are fixed with a synthetic resin, whereby a change of position of a winding is prevented. The iron cores are made of metal powder and synthetic resin compressed to ring shape, or of sintered material. Iron cores of this kind, particularly in the case of sintered material, are very brittle and thus cannot withstand high mechanical forces as occur, for example, with large constructional shapes and at high rotation numbers. Thus, for example, rotary joints for use in computer tomographs are needed to have diameters of up to 1.5 m at rotation numbers up to 240 rpm. Thus, disadvantages of known rotary joints are a low ability to bear mechanical load, and also a high fabrication outlay.

The invention is based on the object of creating a rotary joint that combines good transmission characteristics with an ability to bear mechanical load, and a simple fabrication process.

This object is achieved with a rotary joint having the features of claim 1.

The rotary joint has at least two component parts which are rotatable relative to each other, between which electrical signals and/or energy can be transmitted by induction. As distinct from what is known in prior art, at least one of the rotatable component parts comprises a synthetic resin to which soft magnetic particles have been added as a filler. A synthetic resin of this kind is also termed a "soft magnetic synthetic resin."

The synthetic resin encloses the coils at least partially. Preferably the coils are wound onto coil formers, whereby their positions and shapes in the component parts can be exactly predetermined, i.e. during casting of the component parts the coils are maintained in a defined position and in a defined shape in their respective casting molds. Thus, even air gaps can be created—where necessary. The synthetic resin body with soft magnetic particles can simultaneously act as a coil former. Thus, component parts of synthetic resin may be manufactured precisely without sharp edges (as possessed by iron or ferrite cores). Therefore they may be provided with windings simply and without damaging the wire.

Owing to the high mechanical load-bearing ability which is achievable with synthetic resins, and because synthetic resin workpieces may be manufactured to be of almost any desired shape, the component parts can also serve the mechanical purposes of respective componentry in addition to transmitting data or energy. Fields of application are solar paddles of satellites, or robot arms.

In a respective component part, the soft magnetic particles may have an inhomogeneous distribution that is matched to the desired magnetic flux, i.e. regions of high magnetic flux density have a higher particle concentration than regions of low magnetic flux density. The efficiency of the rotary joint can be optimized thereby. For further optimization, soft magnetic components parts also may be integrally cast.

Preferably the particles are of iron, ferrite, or an iron alloy. The particles may be powdered or even chip-like. The particles used as fillers may consist also of a mixture of various materials. The particles are preferred to have a size (maximum diameter) of less than 1 mm, more preferred of less than 0.5 mm, and most preferred of less than 0.1 mm.

Basically, synthetic resin is here understood to be a polymeric material such as, for example, PVC, PTFE, polyamide, or even a cured synthetic resin.

The synthetic resin is preferably fiber-reinforced. This achieves high ability of a particular component part to bear mechanical load. Carbon and glass fibers, for example, may be used as fibers, particularly in the shape of layered structures and/or woven fabrics. Thus, the rotary joint can serve not only to transmit energy or signals, but may be used also as a mechanical structure. For example, one of the component parts of the rotary joint may be incorporated in a robot arm.

Other component parts may be integrally cast with the synthetic resin. If electronic components are integrally cast, then they are well protected from damp and mechanical load, such as vibrations, for example.

Preferably the rotary joint comprises additional data paths incorporated, i.e. cast at least partially integral, in the synthetic resin. Likewise, the data paths may also be mounted on the rotary joint by other fastening means, for example screwing and/or an adhesive. These data paths, for example, may be optical, capacitive, or other inductive data paths.

In case the two component parts are directly joined to each other via a bearing, a bearing mounting also may be integrally cast. The same applies to additional mountings.

Preferably the rotary joint has a slide track on at least one of the component parts, by means of which the electric potential of the component part can be defined. Thus, the component part may be grounded, for example. However, other signals or additional energies may be transmitted also via one or a plurality of slide tracks.

The synthetic resin component part with the soft magnetic filler particles can be cast (injection molded, spin cast etc.), extruded, and/or laminated. If a component part is laminated, then the spatial particle concentration can be easily matched to a desired variation of magnetic flux by using, in each case, a synthetic resin with a concentration of soft magnetic particles matched to its location when impregnating the layered structures. During casting, suitable matching of the particle concentration is possible with a multi-stage casting method. During extrusion, synthetic resins of different concentrations of soft magnetic particles may be pressed simultaneously to a single strand. The spatial particle distribution of the complete strand is then determined by the shape of the nozzle used for extrusion, amongst other factors. An extrusion-molded section may be joined together to form a ring, for example, before being cured. Likewise, a section of this kind may be laid into another section or a groove, for example in a bearing shell, whereby it is given its final shape. If an elastic or plastic synthetic resin material is used, then the part also may be formed by bending it to a ring later. For the sake of simplicity, in the present application "casting" is understood to mean also "laminating" and "extrusion molding."

The choice of the synthetic resin depends on the prospective field of application. Basically, thermoplastics as well as resins or rubber-like materials may be used.

Rotary joints of the invention are primarily intended for rotary transmission between component parts which are rotatable relative to each other, such as rotor and stator in a computer tomograph. However, the same principle applies to linear or other movements, for example those of linearly movable crane installations, for example. Rotary joints of the invention are dimensioned primarily for high power transmission, for example in a range of 10 kW to 100 kW required in computer tomographs. Basically however, lower power or even data can be transmitted. It is also possible to combine electric circuits carrying different power and/or data with each other. For this, the individual circuits may be separated from each other spatially or temporally, or according to frequency ranges.

The drawings illustrate 3 examples of embodiment according to the invention in a schematically simplified form. Shown by:

FIG. 1: is a section through a component part of a rotary joint comprising a synthetic resin with soft magnetic particles.

Figure 2:
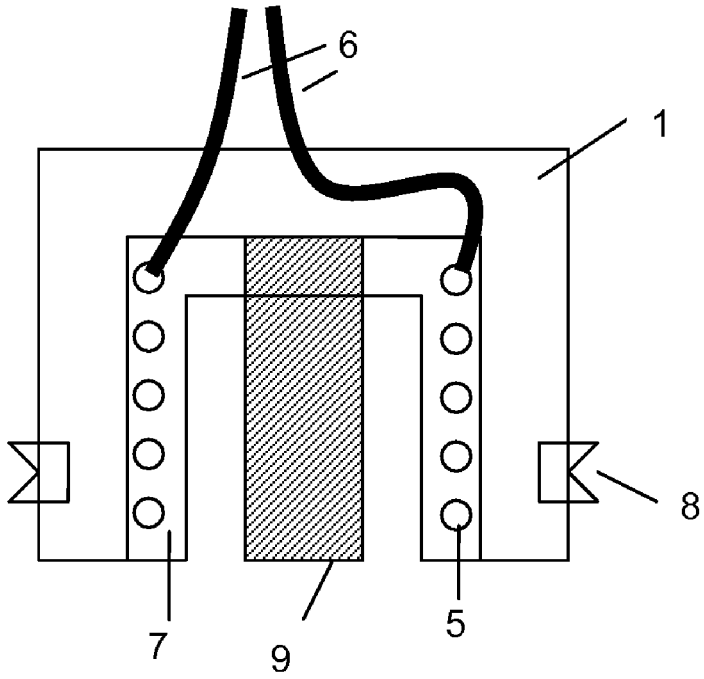

FIG. 2: is a section of a component part of another rotary joint comprising a synthetic resin with soft magnetic particles.

Figure 3:
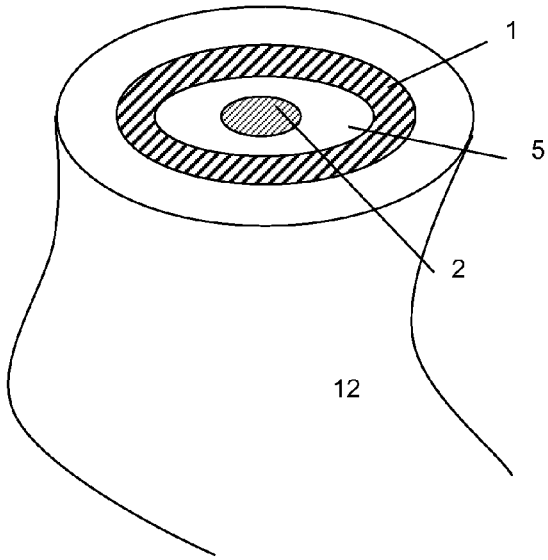

FIG. 3: is a robot arm into which synthetic resin with soft magnetic particles has been cast.

Figure 4:
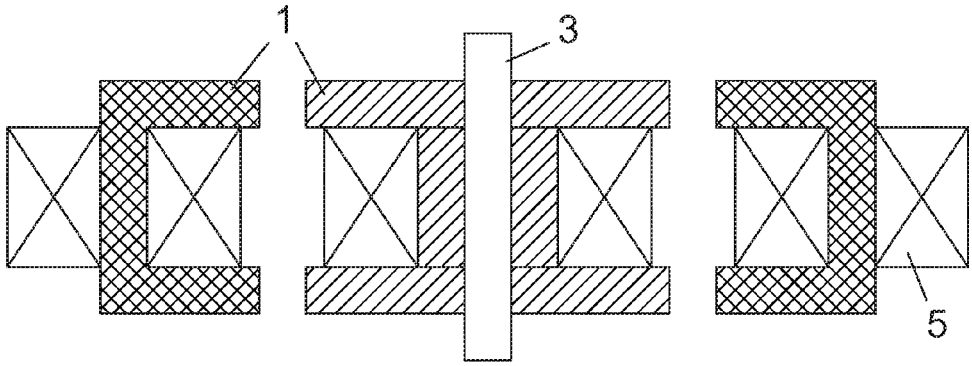

FIG. 4: is a component part of a rotary joint comprising a synthetic resin with soft magnetic particles.

Figure 5:
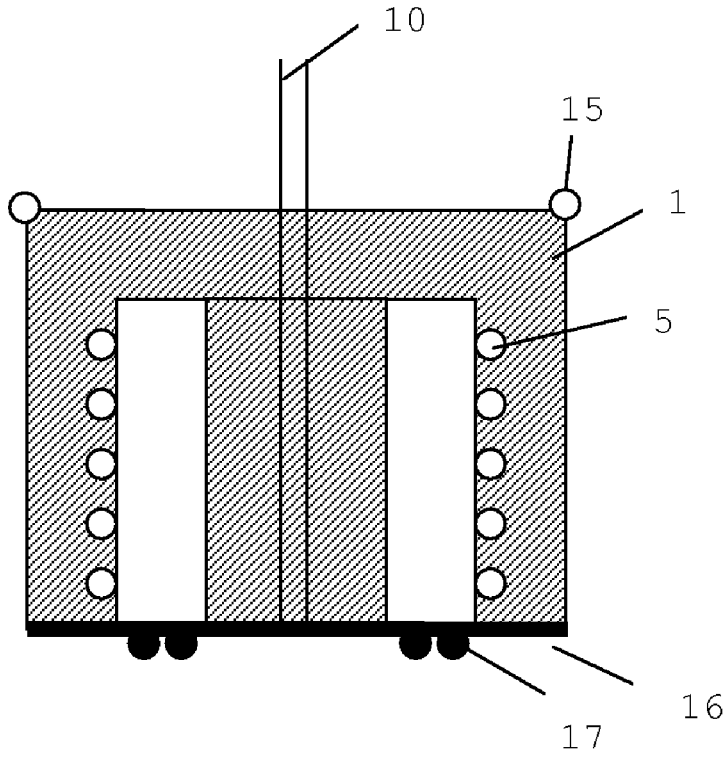

FIG. 5: is a component part of a rotary joint comprising a synthetic resin with soft magnetic particles and other additional components.

FIG. 1 illustrates a section through a component part of a rotary joint comprising a synthetic resin with soft magnetic particles. A U-shaped body (1) of synthetic resin with soft magnetic particles accommodates the winding (5). For example, this may be placed into recesses of the U-shaped body (1), or integrally cast with the material thereof. A coil former (7) provides support for the coil, so that the individual windings are fixed in the recesses. During casting, the winding first may be wound onto the coil support, and then integrally cast with the synthetic resin material. A slide track (8) which is also placed into a groove, or even better, integrally cast, serves for galvanic transmission. The leads (6) of the winding (5) also may be integrally cast with the synthetic resin material and thereby relieved from mechanical tension. An optional central leg may consist of conventional iron or ferrite. Likewise, it may also comprise a synthetic resin material with soft magnetic particles.

FIG. 3 shows a robot arm (12) in which a body (1)(2) of a synthetic resin material with soft magnetic particles is integrally cast to enclose the winding (5). Here the body has, by way of example, the shape of a shell type core with the outer edge (1) and the pocket (2) which are (not visibly) joined together.

FIG. 4 shows a section of another rotary joint. The rotor in the center of the illustration is rotatable relative to the outer stator (shown in section on the left and right hand side thereof) via a shaft (3). This shaft may be also hollow. The component parts (1) of synthetic resin material with soft magnetic particles accommodate the windings (5).

FIG. 5 furthermore shows a component part of a rotary joint in which, in addition, light guides (10) for optical transmission, and also a bearing shell (15) for a bearing have been integrally cast. Moreover, a printed circuit board (16) with capacitive coupling elements (17) is also incorporated.

The invention claimed is:

1. An inductive rotary joint having at least two component parts which are movable relative to each other, and which each have at least one coil for introducing power and/or taking-up power, wherein at least one of the component parts is made of a synthetic fiber-reinforced resin containing an inhomogeneous distribution of soft magnetic particles providing a desired variation of magnetic flux within the at least one component part, and wherein the coil of the at least one component part is at least partially located within the synthetic resin.

2. The rotary joint according to claim 1, wherein at least one particle is of ferrite or iron or an iron alloy.

3. The rotary joint according to claim 1, wherein at least one other component is at least partially integrally cast with the resin.

4. The rotary joint according to claim 3, wherein the at least one other component is a part of a data transmission path.

5. The rotary joint according to claim 3, wherein the at least one other component is a bearing.

6. The rotary joint according to claim 1, wherein at least one of the component parts comprises a slip-ring.

7. The rotary joint according to claim 1, wherein at least one of the component parts directly serves to transmit energy and/or signals, and also is of mechanical functionality adapted for securing additional component parts at least partially in or on the at least one of the component parts.

8. A method for manufacturing a rotary joint having at least two component parts which are movable relative to each other, of which at least one component part is made at least partially of a synthetic resin, comprising the step of admixing soft magnetic particles with the synthetic resin as a filler, such that the soft magnetic particles are distributed inhomogeneously within the at least one component part, wherein a coil former is at least partially integrally cast with or laminated in the synthetic resin component part.

* * * * *